US005408075A

United States Patent [19]

De Matteis et al.

[11] Patent Number: 5,408,075

[45] Date of Patent: Apr. 18, 1995

[54] METHOD AND APPARATUS FOR CONTROLLING A MICRO WAVE COOKER WITH A BROWNING DEVICE

[76] Inventors: Michel G. De Matteis, 11 Rue des Hares-Vice, F-14160 Cambes en Plaine, France; Jean-Louis M. R. Guilgue, Grande rue, F-14440 Beny-Sur-Mer, France

[21] Appl. No.: 190,373

[22] Filed: Feb. 2, 1994

[30] Foreign Application Priority Data

Feb. 2, 1993 [FR] France ..... 93 01114

[51] Int. Cl.[6] ..... H05B 6/68

[52] U.S. Cl. ..... 219/708; 219/518; 219/704

[58] Field of Search ..... 219/708, 702, 704, 707, 219/719, 685, 518; 99/325

[56] References Cited

U.S. PATENT DOCUMENTS

| | | | |
|---|---|---|---|
| 3,783,219 | 1/1974 | Tateda | 219/685 |
| 4,629,848 | 12/1986 | Yokozeki et al. | 219/719 |
| 4,814,570 | 3/1989 | Takizaki | 219/705 |
| 4,874,928 | 10/1989 | Kasai | 219/707 |
| 4,895,067 | 1/1990 | Ohji et al. | 219/708 |
| 5,293,019 | 3/1994 | Lee | 219/708 |

*Primary Examiner*—Philip H. Leung
*Attorney, Agent, or Firm*—Young & Thompson

[57] ABSTRACT

Cooking apparatus (1) including a cooking chamber (2) comprising an electric resistance browning device (3) for the foodstuff disposed in the chamber (2) and a device (4) for the generation of microwave energy disposed outside the cooking chamber (2) and adapted to supply the chamber with microwave energy. An electric supply circuit supplies the browning device (3) and/or the device (4) for generation of microwave energy. A selector permits triggering a heating sequence to be performed on a foodstuff. This sequence causing the browning device and/or the device for the generation of microwave energy to kick in. The selector recognizes the nature and weight of the foodstuff, and a control actuates the electrical supply circuit as a function of information from the selector. The control comprises a storage memory receiving the information from the selector, and a microprocessor supplying signals applied to the supply circuit as a function of the information contained in the storage memory. The storage memory contains values i corresponding to heating sequences; code numerals $\alpha_i$ corresponding each to one particular type of foodstuff for a predetermined value i, and delimited, for each value i, between a lower value $m_i$ and an upper value $M_i$; and tables of values corresponding to coefficients of slopes $km_i$ and $kM_i$ of curves for optimizing heating of a foodstuff which are predetermined as a function of the values i, and which represent the heating time of the cooking apparatus as a function of the weight of the foodstuff, the coefficients corresponding respectively to maximum and minimum values of the slope of the curves.

8 Claims, 2 Drawing Sheets

METHOD AND APPARATUS FOR CONTROLLING A MICRO WAVE COOKER WITH A BROWNING DEVICE

BACKGROUND OF THE INVENTION

1. Field of the Invention

The present invention relates to a cooking apparatus comprising a cooking chamber comprising an electric resistance browning device for the foods disposed in the interior of said chamber and a device for generation of microwave energy disposed outside the cooking chamber and adapted to supply said chamber with microwave energy, a supply circuit supplying the browning device and/or the device for generation of microwave energy, selection means permitting triggering a heating sequence, said heating sequence causing the browning and/or microwave energy generation device to kick in, and control means which actuate the electrical supply circuit as a function of information from the selection means, said control means comprising a storage memory receiving the information from the selection means and a microprocessor furnishing signals applied to the supply circuit as a function of the information contained in said storage memory.

2. Description of the Prior Art

In known cooking apparatus of this type, when a foodstuff is placed within the cooking chamber, a user commences a heating sequence by selecting a predetermined heating function, a food family as well as its weight and, then by pressing on a button, triggers said heating sequence. The control means determine the heating sequence (browning device and/or device for the generation of microwave energy) thus computing the heating time of the cooking apparatus so that the foodstuff will be subjected to the best treatment possible.

However a family of foodstuffs generally includes several types of foodstuffs. The GAME family includes, for example, chicken, duck, Guinea fowl, quail, pheasant.... The control means, after analysis of the selected family, determines a heating sequence which is adapted to the average population of the family of foodstuffs and not to each type of foodstuff. Moreover, for lightweight foodstuffs and whose heating sequence causes at least the browning device to kick in, the heating sequence calculated by the control means permits obtaining either a foodstuff that is too brown but insufficiently cooked, or an overcooked foodstuff but not sufficiently browned. The heating sequence calculated does not therefore always correspond exactly to the desire of the user, namely to obtain a sufficiently cooked and browned foodstuff no matter what the type and weight of the foodstuff to be treated.

SUMMARY OF THE INVENTION

The object of the invention is to overcome the recited drawbacks by providing a cooking apparatus which, given the type and weight of the foodstuff to be treated, determines the optimum heating sequence selected by the user to obtain a sufficiently cooked and browned foodstuff.

According to a first characteristic of the invention, the storage memory contains:

values i corresponding to heating sequences;

code numerals $\alpha_i$ corresponding each to a particular type of foodstuff for a predetermined value of i, and delimited for each value of i, between a lower value $m_i$ and an upper value $M_i$;

tables of values corresponding to coefficients of slope $km_i$ and $kM_i$ of optimum heating curves for a foodstuff, which are predetermined as a function of the values i, and which represent the heating times of the cooking apparatus as a function of the weight of the foodstuff, said coefficients corresponding respectively to minimum and maximum values of the slopes of said curves.

According to an another advantageous characteristic of the invention, the storage memory contains a table of values of coefficients $a_i$ for each value of i and a threshold value $P_0$ corresponding to a predetermined value of the abscissa of the optimization curves below which, for a heating sequence that causes at least the browning device to kick in, the control means calculating the heating time take into consideration an equilibrium coefficient whose value is determined by the product of the coefficient $a_i$ and the value $P_0$.

Thanks to the heating apparatus according to the invention, the plurality of the selectable codes favor refinement of the optimization heating curves permitting thus to calculate, with a greater precision, the heating time of the cooking apparatus. On the other hand, for heating sequences that cause the browning device to kick in, it is indispensable to take account of the weight of the foodstuff. This is why, with the weight control of the foodstuff relative to a predetermined threshold weight, one acts on the heating time of the cooking apparatus which, if the weight of the foodstuff is less than the threshold weight $P_0$, varies in a nonlinear fashion as a function of the weight of the foodstuff, and, if the weight of the foodstuff is greater than the threshold weight $P_0$, varies in a linear fashion as a function of the weight of the foodstuff.

BRIEF DESCRIPTION OF THE DRAWINGS

The characteristics and advantages of the invention will become apparent from the description which follows, given by way of non-limiting example, with reference to the drawings, in which.

DESCRIPTION OF THE PREFERRED EMBODIMENTS

Figure 1:
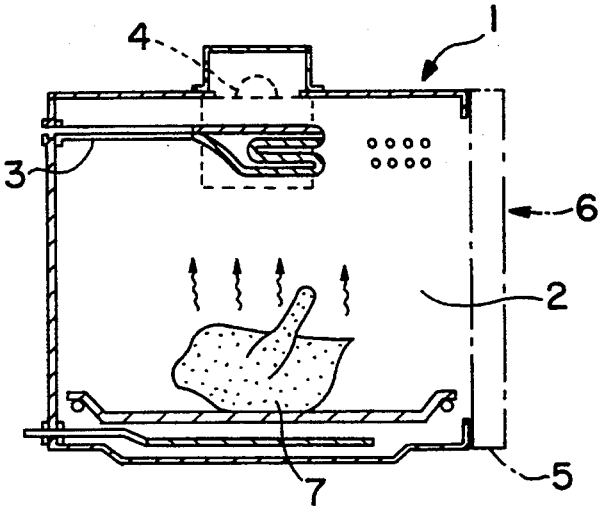
FIG. 1 is a cross-sectional view of a cooking apparatus according to the invention.

According to FIG. 1, a cooking apparatus 1 such as an oven comprises a cooking chamber 2 comprising a browning device 3 disposed within the cooking chamber 2 and a device 4 for the generation of microwave energy disposed outside the cooking chamber 2. An electrical supply circuit (not shown) is adapted to supply the browning device 3 and/or the device 4 for the generation of microwave energy. The cooking chamber 2 is delimited by a door 5 shown in phantom lines and disposed on the forward surface 6 of the cooking apparatus. This forward surface 6 shown in part comprises selection means (not shown) which permit triggering a heating sequence to be performed on the foodstuff 7, given the nature and weight of the foodstuff 7.

The cooking apparatus 1 comprises control means (not shown) which include, on the one hand, a storage memory receiving information from the selection means and, on the other hand, a microprocessor supplying signals applied to the supply circuit as a function of the information contained in the storage memory.

Figure 2:
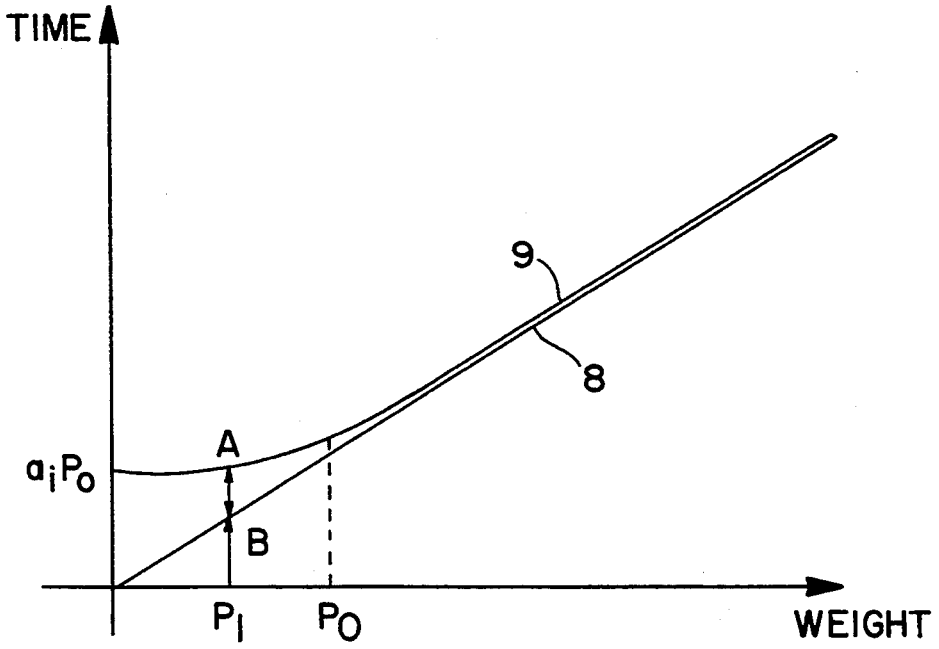
FIG. 2 is a graphical representation of the optimization heating curves, which show, given a predetermined heating sequence, the heating time of the cooking apparatus as a function of the weight of the selected foodstuff.

According to FIG. 2, an optimization curve 8 of a heating sequence of a foodstuff which kicks in only the device for the generation of microwave energy, shows the heating time T defined for example on the ordinates as a function of the weight P of the foodstuff defined for example on the abscissa. Such a curve is of generally rectilinear shape and is defined by the relation $T=KP$, in which K represents the slope of the curve.

For a heating sequence which kicks in at least the browning device, experiments on foodstuffs disposed in a cooking apparatus have permitted defining as a function of the nature and of the weight of the foodstuff an optimization curve 9 of said heating sequence. This curve 9 shows that, for lightweight foodstuffs, the browning by the grill is not proportional to the heating time. During a heating sequence which causes the browning device and the device for the generation of microwave energy to kick in, and for foodstuffs whose weight is $P_1$, the foodstuffs are either well roasted but too cooked, point A of curve 9 or else well cooked but not sufficiently roasted, point B of curve 8.

To take account of the type of foodstuff to be treated, the storage memory of the control means contains:

values i corresponding to the heating sequences, code numerals $\alpha_i$ each corresponding to a particular type of foodstuff for a predetermined and delimited heating sequence, for each heating sequence, between a lower value mi and an upper value $M_i$, tables of values corresponding to coefficients of slopes $km_i$ and $kM_i$ of optimization heating curves for foodstuff, predetermined as a function of the value i, representing the heating time of the cooking apparatus, defined on the ordinates, as a function of the weight of the foodstuff, defined on the abscissa, said coefficients corresponding respectively to minimum and maximum values of the slopes of said curves.

Thanks to said information contained in the storage memory, the control means comprising first computing means determining a slope value $K_i$ of the optimization curve of the heating sequence to be computed for the relationship:

$$K_i = \frac{(kM_i - km_i)(\alpha_i - m_i)}{(M_i - m_i)} + km_i$$

On the other hand, to take account of the effect produced by the browning device, the storage memory contains a table of values of coefficients $a_i$ for each value i and a threshold value $P_0$ corresponding to a predetermined value of the abscissa of the optimization curves below which, for a heating sequence that causes at least the browning device to kick in, the control means calculating the heating time take into consideration an equilibrium coefficient whose value is determined by the product of the coefficient $a_i$ and the value $P_0$. As shown by the curve 9 in FIG. 2, the abscissa $P_0$ corresponds to the point of inflection of the optimization cooking curves for different types of foodstuffs, the section of the coordination curve lower than $P_0$ corresponding to a heating sequence with at least the browning means.

The weight threshold $P_0$ is substantially equal to 400 g. Said control means thus comprise second computing means for, on the one hand, comparing the weight of the selected foodstuff with the threshold weight $P_0$ and, on the other hand, determining, as a function of the result of the comparison of the weights, the heating times of the cooking apparatus.

If the weight of the selected foodstuff is less than or equal to the threshold weight $P_0$, the heating time T is defined by the relationship:

$$T=(K_i-a_i)\,P+a_iP_0$$

If the weight of the foodstuff is greater than or equal to the threshold weight $P_0$, the heating time T is defined by the relationship:

$$T=K_iP$$

To prevent the calculated heating times from being detrimental to good operation of said cooking apparatus, the storage memory contains, for each heating sequence, a maximum heating time not to be exceeded and the control means comprise third computing means which, on the one hand, compare the heating time calculated by the second means with the maximum heating time for a predetermined heating sequence and, on the other hand, as a function of the result of the third computing means, trigger either an error message if the calculated time is greater than the maximum time, or else the heating sequence predetermined by the control means.

Figure 3:
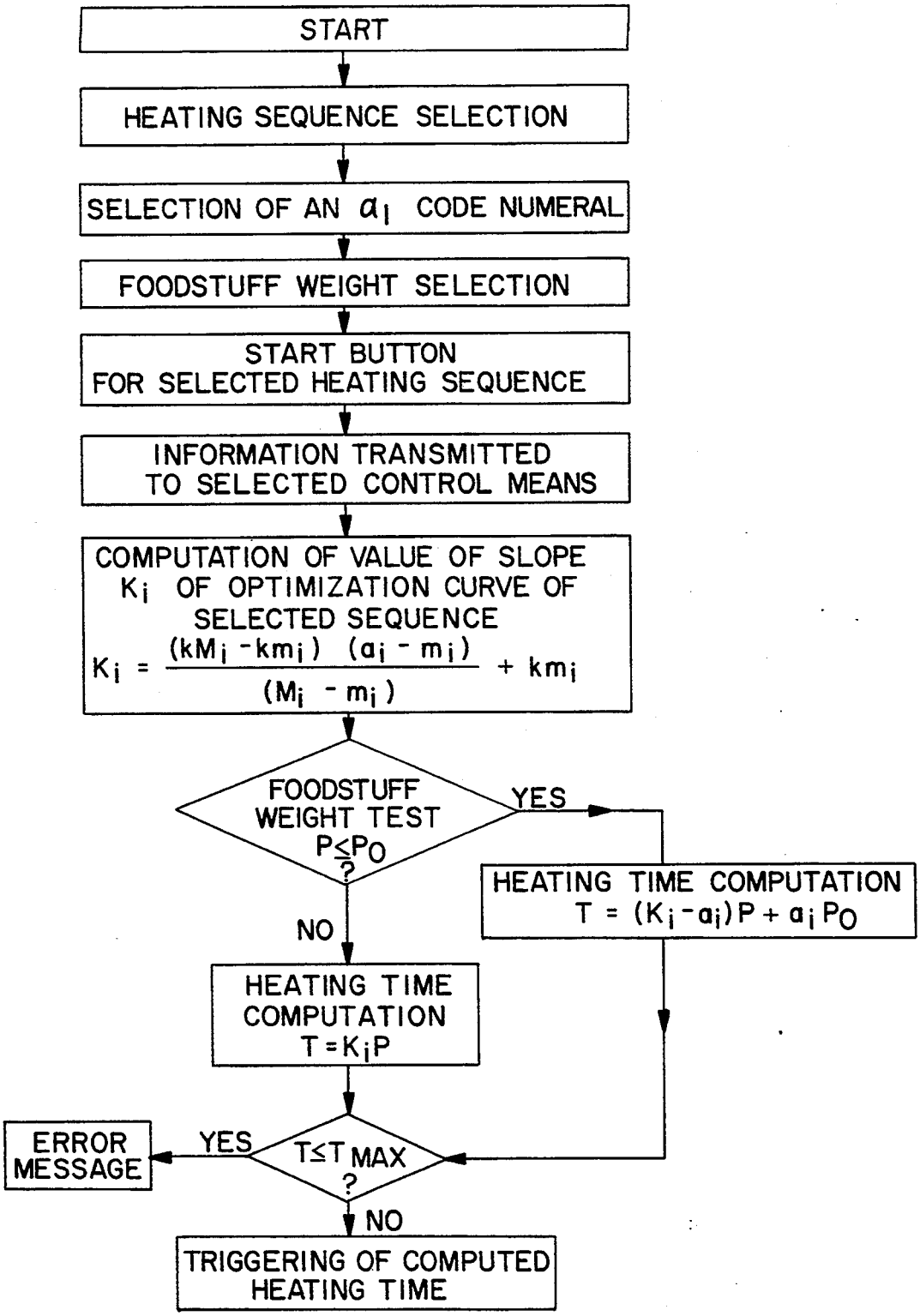
FIG. 3 is a functional diagram showing the control process for heating with the cooking apparatus according to the invention.

So as to illustrate the operation of the oven, there is shown in FIG. 3 a flow diagram corresponding to the process for controlling the cooking of a foodstuff.

In the course of a first operation, after the user has placed a foodstuff to be treated into the cooking chamber, the user selects a heating sequence, the weight of the foodstuff and a code numeral $\alpha_i$ corresponding to the particular foodstuff to be treated. Then, he presses on a start button to trigger the operation of the cooking apparatus. In the course of a second operation, the information input by the user is transmitted to the control means which, given the data stored in the storage memory, determine the value of the slope $K_i$ of the optimization curve of the selected heating sequence.

Then, in the course of a third operation, the control means performs a test on the weight of the foodstuff to be treated relative to the threshold weight $P_0$. In a first case, if the selected heating sequence causes at least the browning device to kick in and if the weight of the foodstuff to be treated is below the threshold weight $P_0$, the control means determine the heating time T from the relationship:

$$T=(K_i-a_i)\,P+a_iP_0$$

In a second case, if the selected heating sequence causes the browning device and/or the device for generation of microwave energy to kick in and if the weight of the foodstuff to be treated is greater than the threshold weight $P_0$, the control means determine the heating time T from the relationship:

$$T=K_iP$$

In each of these two cases, the control means first compares the calculated heating time corresponding to an optimum value of the heating time, with the maximum heating time contained in the storage memory, and then triggers or not the activation of the supply circuit of the browning device and/or device for the generation of microwave energy.

Thus, the process according to the invention offers the advantage of obtaining automatic cooking of the foodstuff thanks to the precision concerning the nature of the foodstuff. Moreover, given the selected heating sequence and the weight of the foodstuff, the optimization curve is refined to approach an ideal optimization curve, said obtained curve permitting responsiveness to the expectations of each user.

What is claimed is:

1. Cooking apparatus (1) comprising a cooking chamber (2), an electric resistance browning device (3) for foodstuffs disposed in said chamber (2), and a microwave energy generation device (4) disposed outside said cooking chamber (2) and supplying said chamber with microwave energy, an electric supply circuit to selectively supply said browning device (3) and said microwave energy generation device (4), selection means permitting a triggering of a heating sequence to be performed on said foodstuff, said sequence causing said browning device and said microwave energy generation device to selectively kick in, said selection means recognizing a nature and weight of said foodstuff, control means actuating said electrical supply circuit as a function of information from said selection means, said control means comprising a storage memory receiving and storing said information from said selection means, and a microprocessor supplying signals applied to said supply circuit as a function of said information contained in said storage memory, wherein said storage memory stores:

values i corresponding to a heating sequence;

code numerals $\alpha_i$ each corresponding to one particular type of foodstuff for a predetermined value i and delimited, for each value i, between a lower value $m_i$ and an upper value $M_i$;

tables of values corresponding to coefficients of slopes $km_i$ and $kM_i$ of curves for optimizing foodstuff heating, said values being predetermined as a function of said values i, and represent a heating time of said cooking apparatus as a function of a weight of said foodstuff, said coefficients corresponding respectively to minimum and maximum values of said slopes of said curves;

a table of values of coefficients ai for each value i;

a threshold weight value $P_0$ corresponding to a predetermined value on an abscissa of said optimization curves;

values defining said optimization curves, said values being a function of the weight of said foodstuff on said abscissa, and a function of corresponding heating time values on an ordinate, said heating time values varying in a linear fashion with increasing weight of foodstuff beyond said threshold weight value $P_0$ and varying in a manner different than said linear fashion, for a heating sequence causing at least said browning device to kick in, with decreasing weight of foodstuff below $P_0$.

2. Cooking apparatus according to claim 1, wherein said control means comprise first computing means utilizing said value i, said code numerals $\alpha_i$, said lower value $m_i$, said upper value $M_i$ and said slope value $km_i$ and $kM_i$ to determine an optimum slope value $K_i$ of the optimization heating curve of the selected heating sequence.

3. Cooking apparatus according to claim 2, wherein said slope value $K_i$ is determined by the relationship:

$$K_i = \frac{(kM_i - km_i)(\alpha_i - m_i)}{(M_i - m_i)} + km_i.$$

4. Cooking apparatus according to claim 1, wherein said control means comprise second computing means which compare the weight of the selected foodstuff with said threshold weight value $P_0$ and determine, as a function of a result of said weight comparison, the heating time of said selected foodstuff in said cooking apparatus.

5. Cooking apparatus according to claim 4, wherein when the weight of the selected foodstuff is less than or equal to the threshold weight value $P_0$, the control means calculate the heating time T by the relationship $$T=(K_i-a_i)\,P+a_i\,P_0$$

and wherein when the weight of the selected foodstuff is greater than said threshold weight value $P_0$, the control means compute the heating time T by the relationship:

$$T=K_iP.$$

6. Cooking apparatus according to claim 4, wherein said storage memory contains, for each heating sequence, a maximum heating time not to be exceeded, and wherein said control means comprise third computing means which compare a computed heating time by said second computing means with the maximum heating time for said selected heating sequence and trigger, as a function of the result of said third computing means, either an error message if the heating time computed is greater than the maximum heating time, or a heating sequence predetermined by said control means.

7. Cooking apparatus according to claim 1, wherein said threshold weight value $P_0$ is substantially equal to 400 grams.

8. Process for the control of cooking of foodstuff in a cooking apparatus comprising the steps of:

in a first operation:

selecting a heating sequence;

selecting a weight of said foodstuff to be cooked;

selecting a code numeral $\alpha_i$ indicative of a type of foodstuff;

triggering a starting of cooking in said cooking apparatus; and, in a second operation:

computing, by a control means of said cooking apparatus, an optimum value for a slope $K_i$ of an optimization curve of said selected heating sequence as a function of said code numeral $\alpha_i$, values i corresponding to said selected heating sequence, said values i being bound by a lower value $m_i$ and an upper value $M_i$, and values $km_i$ and $kM_i$ corresponding to minimum and maximum slope coefficients, respectively; and in a third operation:

comparing, in said control means, the weight of the selected foodstuff with a threshold weight value $P_0$ stored in a storage memory of said cooking apparatus; and, determining, as a function of the weight of the foodstuff and said threshold weight value $P_0$, optimum heating time values in the cooking apparatus, said heating time values varying in a linear fashion with increasing weight of foodstuff beyond $P_0$ and varying in a manner different than said linear fashion with decreasing weight of foodstuff below $P_0$.

* * * * *